US011348515B2

(12) United States Patent
Yang et al.

(10) Patent No.: US 11,348,515 B2
(45) Date of Patent: May 31, 2022

(54) PIXEL COMPENSATION METHOD, PIXEL COMPENSATION DEVICE AND DISPLAY DEVICE

(71) Applicant: BOE TECHNOLOGY GROUP CO., LTD., Beijing (CN)

(72) Inventors: Fei Yang, Beijing (CN); Mingi Chu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/765,284

(22) PCT Filed: Jan. 8, 2020

(86) PCT No.: PCT/CN2020/070918

§ 371 (c)(1),
(2) Date: May 19, 2020

(87) PCT Pub. No.: WO2020/143666

PCT Pub. Date: Jul. 16, 2020

(65) Prior Publication Data

US 2021/0225272 A1 Jul. 22, 2021

(30) Foreign Application Priority Data

Jan. 11, 2019 (CN) ..... 201910026211.5

(51) Int. Cl.
*G09G 3/20* (2006.01)
*G09G 3/32* (2016.01)
(Continued)

(52) U.S. Cl.
CPC ..... *G09G 3/3208* (2013.01); *G09G 3/2074* (2013.01); *G09G 2320/0233* (2013.01); *G09G 2320/045* (2013.01); *G09G 2360/148* (2013.01)

(58) Field of Classification Search
CPC .. G09G 3/2074–3208; G09G 2320/0233–045; G09G 2360/148; H01L 27/288
See application file for complete search history.

(56) References Cited

U.S. PATENT DOCUMENTS 6,518,962 B2 * 2/2003 Kimura ..... H01L 27/3269 345/214
8,558,767 B2 10/2013 Kwon
(Continued)

FOREIGN PATENT DOCUMENTS

CN 101373578 A 2/2009
CN 101477783 A 7/2009
(Continued)

OTHER PUBLICATIONS

International Search Report of PCT/CN2020/070918 in Chinese, dated Apr. 8, 2020, with English translation.

*Primary Examiner* — Lin Li
(74) *Attorney, Agent, or Firm* — Collard & Roe, P.C.

(57) ABSTRACT

A pixel compensation method, a pixel compensation device and a display device. The pixel compensation method includes: generating, according to grayscale data and compensation value of a sub-pixel in a current detection period, a source voltage signal to control light-emitting brightness of the sub-pixel; generating a sensing value according to the light-emitting brightness of the sub-pixel; and determining a compensation value of the sub-pixel in next detection period, according to the grayscale data, the compensation value, and the sensing value of the sub-pixel in the current detection period.

16 Claims, 5 Drawing Sheets

(51) Int. Cl.

| | |
|---|---|
| ***G09G 3/36*** | (2006.01) |
| ***H01L 27/144*** | (2006.01) |
| ***H01L 27/32*** | (2006.01) |
| ***G09G 3/3208*** | (2016.01) |

(56) References Cited

U.S. PATENT DOCUMENTS

| | | | | |
|---|---|---|---|---|
| 2004/0070558 | A1 | 4/2004 | Cok et al. | |
| 2004/0257352 | A1* | 12/2004 | Naugler, Jr. | G09G 3/3233 345/204 |
| 2005/0225519 | A1* | 10/2005 | Naugler, Jr. | G09G 3/3291 345/77 |
| 2005/0285822 | A1* | 12/2005 | Reddy | H01L 27/1446 345/76 |
| 2009/0174628 | A1 | 7/2009 | Wang et al. | |
| 2009/0184903 | A1 | 7/2009 | Kwon | |
| 2015/0103106 | A1* | 4/2015 | Chaji | G09G 3/3291 345/690 |
| 2015/0154908 | A1* | 6/2015 | Nam | G09G 3/3233 345/76 |
| 2015/0187276 | A1* | 7/2015 | Shim | G09G 3/3291 345/77 |
| 2016/0027382 | A1* | 1/2016 | Chaji | G09G 3/006 345/212 |
| 2016/0307498 | A1* | 10/2016 | Chaji | G09G 3/3291 |
| 2017/0154573 | A1* | 6/2017 | Woo | G09G 3/3233 |
| 2018/0137819 | A1* | 5/2018 | An | G09G 3/3233 |
| 2018/0151124 | A1* | 5/2018 | An | G09G 3/3266 |
| 2018/0182303 | A1* | 6/2018 | Jung | G09G 3/3233 |
| 2019/0156753 | A1 | 5/2019 | Yang et al. | |
| 2019/0206299 | A1* | 7/2019 | Kim | G09G 3/20 |
| 2021/0217345 | A1* | 7/2021 | Kang | G09G 3/3607 |

FOREIGN PATENT DOCUMENTS

| | | | | | |
|---|---|---|---|---|---|
| CN | 101488319 | A | | 7/2009 | |
| CN | 101697268 | A | | 4/2010 | |
| CN | 106782306 | A | * | 5/2017 | G09G 3/3208 |
| CN | 107799069 | A | | 3/2018 | |
| CN | 108320716 | A | * | 7/2018 | G09G 3/3607 |
| CN | 109599060 | A | | 4/2019 | |
| CN | 110743502 | A | * | 11/2019 | G09G 3/3225 |
| CN | 107610143 | B | * | 5/2020 | G09G 3/20 |

* cited by examiner

PIXEL COMPENSATION METHOD, PIXEL COMPENSATION DEVICE AND DISPLAY DEVICE

CROSS REFERENCE TO RELATED APPLICATIONS

This application is the National Stage of PCT/CN2020/070918 filed on Jan. 8, 2020, which claims priority under 35 U.S.C. § 119 of Chinese Application No. 201910026211.5 filed on Jan. 11, 2019, the disclosure of which is incorporated by reference.

TECHNICAL FIELD

Embodiments of the present disclosure relate to a pixel compensation method, a pixel compensation device, and a display device.

BACKGROUND

Nowadays, people not only have strict requirements on the performance and quality of products, but also pay more attention to the price and practicality of products. In the display field, especially the OLED (Organic Light-Emitting Diode) display field, because of its excellent functions such as wide color gamut, a wide viewing angle, thinness, low weight, low energy consumption, high contrast, and bendability, OLED displays are widely accepted by the people and gradually become the future development direction of display technology.

However, in the field of large-size display, the instability of each sub-pixel unit causes the picture quality to decrease, and improving the display quality of the picture has always been the direction of technical personnel. Generally, each sub-pixel unit requires being compensated to improve the display performance of the display panel.

It should be noted that the information disclosed in the above background section is only for enhancing the understanding of the background of the present disclosure, and therefore may include information that does not constitute prior art known to those of ordinary skill in the art.

SUMMARY

At least one embodiment of the present disclosure provides a pixel compensation method. The pixel compensation method comprises:

generating, according to grayscale data and a compensation value of a sub-pixel in a current detection period, a source voltage signal to control light-emitting brightness of the sub-pixel;

generating a sensing value according to the light-emitting brightness of the sub-pixel; and determining a compensation value of the sub-pixel in next detection period, according to the grayscale data, the compensation value, and the sensing value of the sub-pixel in the current detection period.

In an exemplary embodiment of the present disclosure, the pixel compensation method further comprises:

generating a source voltage signal in the next detection period according to preset grayscale data of the sub-pixel and the compensation value in the next detection period, and outputting the source voltage signal to a source driver.

In an exemplary embodiment of the present disclosure, the determining the compensation value of the sub-pixel in the next detection period, according to the grayscale data, the compensation value, and the sensing value of the sub-pixel in the current detection period comprises:

determining a brightness curve of the sub-pixel, according to a plurality of pieces of grayscale data, a plurality of sensing values corresponding to the plurality of pieces of grayscale data, and a compensation offset value of the sub-pixel in the current detection period;

determining a compensation offset value change amount and a compensation gain value of the sub-pixel in the next detection period, according to the brightness curve of the sub-pixel and an ideal brightness curve of the sub-pixel; and determining the compensation value of the sub-pixel in the next detection period, according to the compensation offset value change amount and the compensation gain value of the sub-pixel in the next detection period and the compensation value in the current detection period.

In an exemplary embodiment of the present disclosure, the determining the brightness curve of the sub-pixel, according to the plurality of grayscale data, the plurality of sensing values corresponding to the plurality of grayscale data, and the compensation offset value of the sub-pixel in the current detection period comprises:

according to first gray scale data and second gray scale data, a first brightness sensing value and a second brightness sensing value respectively corresponding to the first gray scale data and the second gray scale data, and the compensation offset value of the sub-pixel in the current detection period, determining the brightness curve of the sub-pixel according to following formulas:

$$S1=K2*(V1+Vth-Vth_1)^2=K2*(V1-\Delta Vth)^2\approx K2*(V1^2-2*V1*\Delta Vth)$$

$$S2=K2*(V2+Vth-Vth_1)^2=K2*(V2-\Delta Vth)^2\approx K2*(V2^2-2*V1*\Delta Vth)$$

where V1 represents the first grayscale data, V2 represents the second grayscale data, S1 represents the first brightness sensing value, S2 represents the second brightness sensing value, K2 represents the compensation gain value, Vth represents the compensation offset value, ΔVth represents the compensation offset value change amount, ΔVth=Vth1−Vth, and Vth1 represents a turn-on voltage value of the sub-pixel.

In an exemplary embodiment of the present disclosure, the determining the compensation offset value change amount and the compensation gain value of the sub-pixel in the next detection period, according to the brightness curve of the sub-pixel and the ideal brightness curve of the sub-pixel comprises:

according to the first gray scale data and the second gray scale data, first ideal brightness data and second ideal brightness data respectively corresponding to the first gray scale data and the second gray scale data, and an ideal compensation gain value, determining the ideal brightness curve according to following formulas:

$$ST1=K1*(V1)^2$$

$$ST2=K1*(V2)^2$$

where ST1 represents the first ideal brightness data, ST2 represents the second ideal brightness data, and K1 represents the ideal compensation gain value; and determining the compensation offset value change amount and the compensation gain value of the sub-pixel in the next detection period according to following formulas:

$$\Delta Vth = \frac{V1^2 - \frac{S1}{S2} * V2^2}{2*\left(V1 - \frac{S1}{S2} * V2\right)}$$

$$K2 = \frac{S1 - S2}{ST1 - ST2} * K1.$$

In an exemplary embodiment of the present disclosure, the generating the source voltage signal in the next detection period, according to the preset grayscale data of the sub-pixel and the compensation value in the next detection period comprises:

calculating, according to the preset grayscale data of the sub-pixel and the compensation value in the next detection period, the source voltage signal by a following formula:

$$\text{Data2}=LUT(K2)\times\text{Data1}+Vth+\Delta Vth$$

where Data1 represents the preset grayscale data, Data2 represents the source voltage signal, and LUT represents a mapping function.

At least one embodiment of the present disclosure also provides a pixel compensation device. The pixel compensation device comprises:

an algorithm compensation circuit configured to generate, according to grayscale data and compensation value of a sub-pixel in a current detection period, a source voltage signal to control light-emitting brightness of the sub-pixel; and a coefficient calculation circuit configured to be determine a compensation value of the sub-pixel in next detection period, according to the grayscale data and the compensation value of the sub-pixel in the current detection period and a sensing value generated according to the light-emitting brightness provided by the sub-pixel which is driven by the source voltage signal.

In an exemplary embodiment of the present disclosure, the pixel compensation device further comprises a light sensing device, wherein the light sensing device is configured to generate the sensing value according to the light-emitting brightness of the sub-pixel.

In an exemplary embodiment of the present disclosure, the algorithm compensation circuit is further configured to generate a source voltage signal in the next detection period according to preset grayscale data of the sub-pixel and the compensation value in the next detection period, and output the source voltage signal to a source driver.

In an exemplary embodiment of the present disclosure, the pixel compensation device further comprises a brightness conversion circuit:

wherein the brightness conversion circuit is configured to receive the grayscale data of the sub-pixel, convert the grayscale data into a brightness voltage signal, and output the brightness voltage signal to the algorithm compensation circuit.

In an exemplary embodiment of the present disclosure, the pixel compensation device further comprises a timing control circuit:

wherein the timing control circuit is configured to receive a timing signal, and generate, according to the timing signal, a source voltage signal for controlling a source driver and a gate voltage signal for controlling a gate driver.

At least one embodiment of the present disclosure also provides a pixel compensation device. The pixel compensation device comprises:

a processor; and a memory configured to store instructions which, when executed by the processor, cause the processor to perform following operations:

generating, according to grayscale data and a compensation value of a sub-pixel in a current detection period, a source voltage signal to control light-emitting brightness of the sub-pixel; and determining a compensation value of the sub-pixel in next detection period, according to the grayscale data and the compensation value of the sub-pixel in the current detection period and a sensing value generated by a light sensing device.

At least one embodiment of the present disclosure also provides a display device. The display device includes any of the aforementioned pixel compensation devices.

It should be understood that the above general description and the following detailed description are only exemplary and explanatory, and do not limit the present disclosure.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
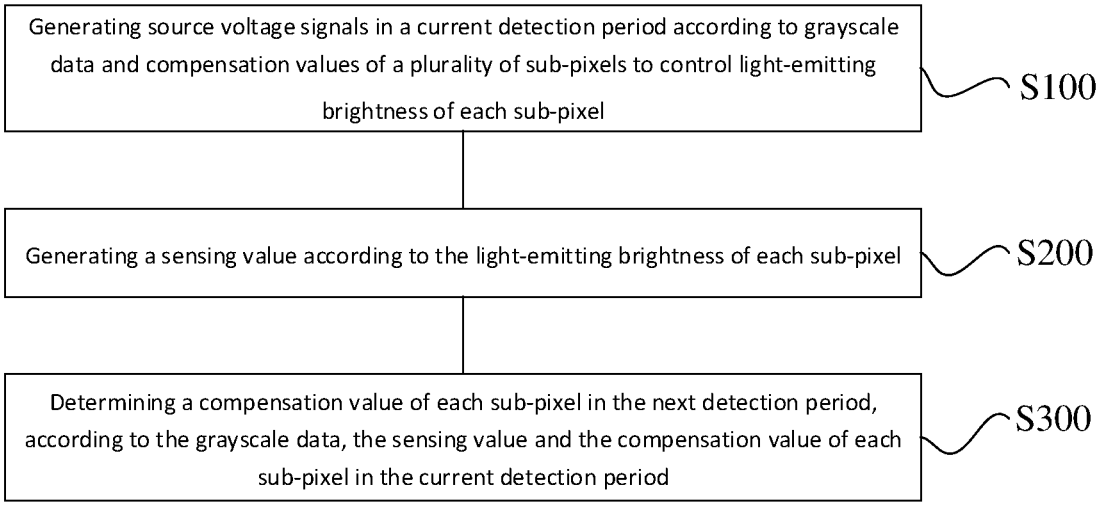
FIG. 1 is a flow chart of a pixel compensation method provided by at least one embodiment of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Regarding the external compensation algorithm of sub-pixels, the compensation methods for improving picture quality mainly include TFT compensation methods (a mobility K and a threshold voltage Vth), OLED compensation methods (a efficiency E), and external optical compensation method (obtaining the compensation amount of each sub-pixel at different brightness by using a CCD to shoot, and the compensation amount is composed of a slope K1 and a offset K2), temperature compensation methods (T), etc. There are six compensation factors (K, Vth, E, K1, K2, T) at most, which makes the compensation algorithm of OLED pixels more and more complicated, and it is impossible to distinguish the role of each factor in the compensation methods, thereby causing the problem of inaccurate compensation.

At least one embodiment of the present disclosure provides a pixel compensation method including:

generating a source voltage signal according to grayscale data and a compensation value of a sub-pixel in a current detection period to control light-emitting brightness of the sub-pixel;

generating a sensing value according to the light-emitting brightness of the sub-pixel; and determining a compensation value of the sub-pixel in a next detection period according to the grayscale data, the compensation value and the sensing value of the sub-pixel in the current detection period.

FIG. 1 is a flow chart of a pixel compensation method provided by at least one embodiment of the present disclosure. As illustrated in FIG. 1, the pixel compensation method includes:

step S100: generating source voltage signals in a current detection period according to grayscale data and compensation values of a plurality of sub-pixels to control light-emitting brightness of each sub-pixel;

step S200: generating a sensing value according to the current light-emitting brightness of each sub-pixel;

step S300: determining a compensation value of each sub-pixel in next detection period, according to the grayscale data, the sensing value and the compensation value of each sub-pixel in the current period.

For example, the compensation value in the next detection period determined in step S300 is also used in the next display period.

The pixel compensation method provided by the embodiment of the present disclosure can determine the compensation value of each sub-pixel in the next detection period according to the grayscale data, the sensing value and the compensation value of each sub-pixel in the current detection period. In the process of determining the compensation value for the next detection period, according to the current light-emitting brightness of each sub-pixel, the comprehensive aging condition of each sub-pixel unit can be obtained to output the corresponding sensing value, and then the compensation value of each sub-pixel in the next detection period can be determined by using the sensing value, so as to compensate for the comprehensive aging condition of the entire pixel of each sub-pixel unit, which can solve the problem of afterimages and the phenomenon of various traces caused by uneven brightness of a plurality of sub-pixels at one time, thereby simplifying the sub-pixel compensation algorithm and improving the accuracy of pixel compensation.

Figure 2:
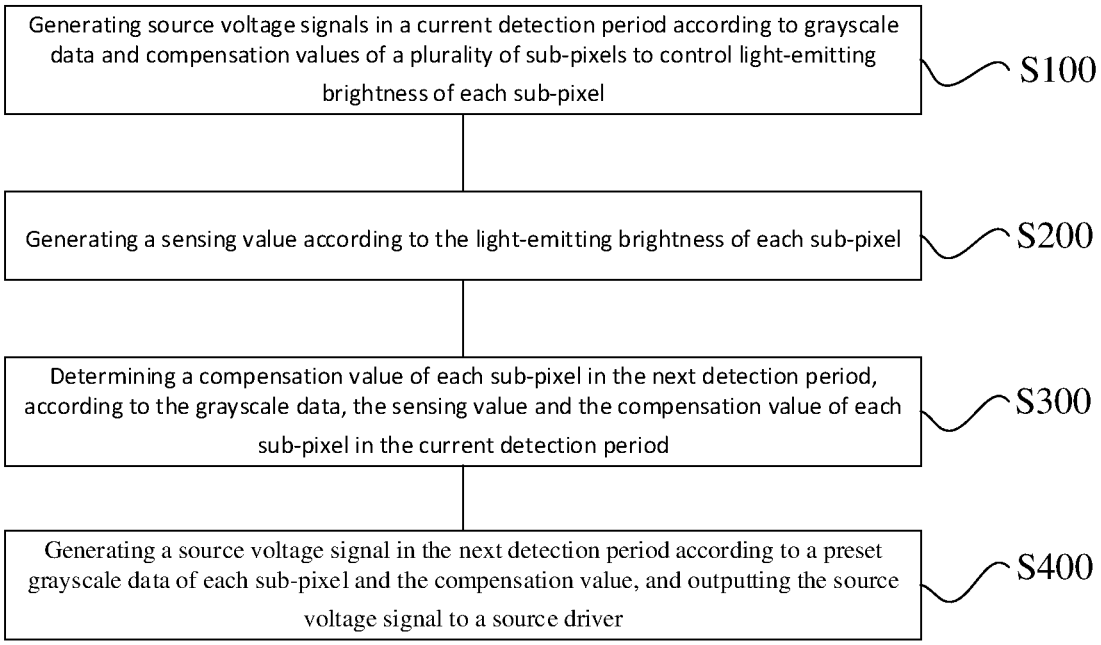
FIG. 2 is a flow chart of another pixel compensation method provided by at least one embodiment of the present disclosure.

As illustrated in FIG. 2, the pixel compensation method provided by at least one embodiment of the present disclosure further includes:

Step S400: generating a source voltage signal in the next detection period according to a preset grayscale data of each sub-pixel and the compensation value in the next detection period, and outputting the source voltage signal to a source driver.

It should be understood that the pixel compensation method provided by the embodiments of the present disclosure is not limited to, for each sub-pixel, determining the compensation value of the sub-pixel in the next detection period by using the sensing value generated according to the light-emitting brightness of the sub-pixel. In some embodiments, the compensation value of the sub-pixel in the next detection period can be determined by using the sensing value generated according to the light-emitting brightness of other sub-pixels. For example, in some embodiments, the sensing value may be generated based only on the light-emitting brightness of a part of sub-pixels, and the compensation value of the part of the sub-pixels in the next detection period and the compensation value of the other part of the sub-pixels in the next detection period are determined by using the sensing value generated according to the light-emitting brightness of this part of sub-pixels, which is not limited by the embodiments of the present disclosure.

Hereinafter, each step of the pixel compensation method in this exemplary embodiment will be further described.

In step S100, the source voltage signal is generated in the current detection period according to the grayscale data and the compensation values of a plurality of sub-pixels to control the light-emitting brightness of each sub-pixel.

For example, in the current detection period, during the inter-frame interval, each sub-pixel generates a plurality of source voltage signals based on a plurality of grayscale data in combination with the compensation values, and each sub-pixel generates different light-emitting brightness according to the plurality of source voltage signals.

In step S200, the sensing value is generated according to the current light-emitting brightness of each sub-pixel.

For example, according to the current light-emitting brightness of each sub-pixel, the comprehensive aging condition of each sub-pixel unit can be obtained to output the corresponding sensing value, and then the compensation value of each sub-pixel in the next detection period can be determined by using the sensing value, so as to compensate for the comprehensive aging condition of the entire pixel of each sub-pixel unit, which can solve the problem of afterimages and the phenomenon of various traces caused by uneven brightness of a plurality of sub-pixels at one time.

A photosensitive device, such as a PIN junction, can be used. When each sub-pixel generates corresponding brightness according to the grayscale data, light is projected onto the PIN junction. When the intensity of the received light is greater, the current flowing through the PIN junction is greater, so that the comprehensive aging condition of each sub-pixel can be obtained by using the PIN junction to output the corresponding sensing value.

Figure 3:
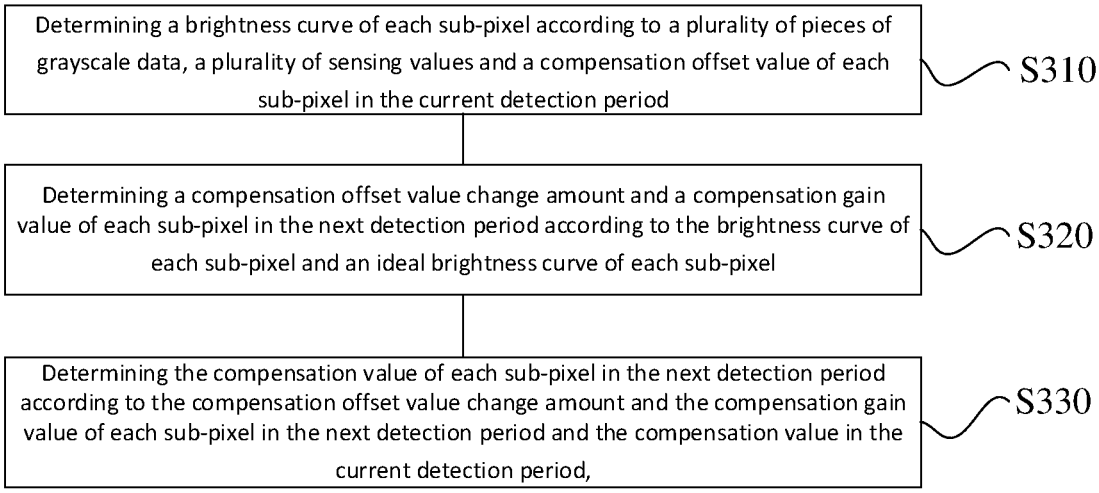
FIG. 3 is a flow chart of step S300 of a pixel compensation method provided by at least one embodiment of the present disclosure.

In step S300, the compensation value of each sub-pixel in the next detection period is determined according to the grayscale data, the sensing value and the compensation value of the current period of each sub-pixel. As illustrated in FIG. 3, step S300 includes steps S310-S330.

Step S310: determining a brightness curve of each sub-pixel according to a plurality of pieces of grayscale data, a plurality of sensing values and a compensation offset value of each sub-pixel in the current detection period.

For example, there may be two pieces of grayscale data and two sensing values of each sub-pixel. For example, the grayscale data includes first grayscale data and second grayscale data, such as V1 and V2, the compensation value of the current period includes a compensation offset value Vth, two sensing values, i.e., a first brightness sensing value and a second brightness sensing value, such as S1 and S2, are determined according to V1+Vth and V2+Vth, an actual compensation gain value K2 and a turn-on voltage Vth1 of the sub-pixel are preset, and a brightness curve function of each sub-pixel is determined as:

$$S1=K2*(V1+Vth-Vth_1)^2$$

$$S2=K2*(V2+Vth-Vth_1)^2$$

The brightness curve of the sub-pixel is fitted through V1+Vth, S1, V2+Vth, and S2, where V1+Vth and V2+Vth are taken as the X coordinate values, and S1 and S2 are taken as the Y coordinate values.

In addition, more sensing values, such as S3, can be obtained through more grayscale data, such as V3, and then the voltage brightness curve of each sub-pixel can be fitted through three sets of sensing data (V1+Vth, S1, V2+Vth, S2, V3+Vth, S3) or more sets of sensing data. It should be clear to those skilled in the art that the use of more sets of sensing data can make the actual compensation gain value K2 more accurate, and thus can make the calculated brightness curve more accurate.

Step S320: determining a compensation offset value change amount and a compensation gain value of each sub-pixel in the next detection period according to the brightness curve of each sub-pixel and an ideal brightness curve of each sub-pixel.

For example, the ideal brightness curve of each sub-pixel is obtained as follows. In the case where the grayscale data includes the first grayscale data and the second grayscale data, such as V1 and V2, the calculation formula of the ideal brightness of each sub-pixel is:

$$ST1=K1*(V1)^2$$

$$ST2=K1*(V2)^2$$

where ST1 is first ideal brightness data, ST2 is second ideal brightness data, and K1 is an ideal compensation gain value. For example, the first ideal brightness data ST1, the second ideal brightness data ST2 and the ideal compensation gain value K1 are preset. For example, the first ideal brightness data ST1, the second ideal brightness data ST2 and the ideal compensation gain value K1 may be theoretically derived or experimentally measured, which is not limited by the embodiments of the present disclosure.

The compensation offset value change amount ΔVth is preset to obtain the calculation formula of the actual brightness of the sub-pixel as follows:

$$S1=K2*(V1+Vth-Vth_1)^2=K2*(V1-\Delta Vth)^2\approx K2*(V1^2-2*V1*\Delta Vth)$$

$$S2=K2*(V2+Vth-Vth_1)^2=K2*(V2-\Delta Vth)^2\approx K2*(V2^2-2*V1*\Delta Vth)$$

Figure 7:
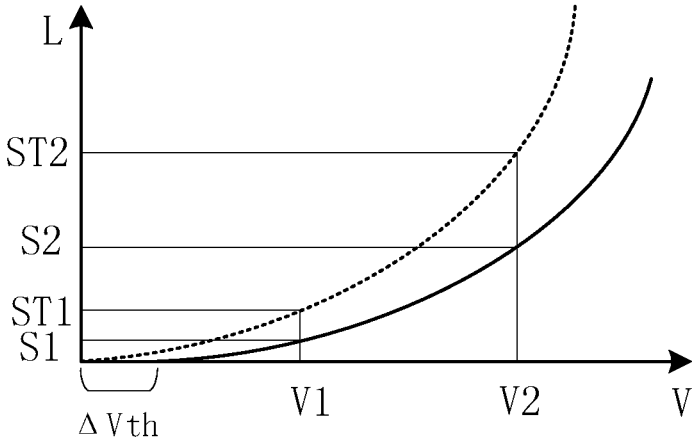
FIG. 7 is a schematic diagram of an ideal brightness curve and an actual brightness curve of a sub-pixel provided by at least one embodiment of the present disclosure.

As illustrated in FIG. 7, the dotted line is the ideal brightness curve of the sub-pixel, and the solid line is the actual brightness curve. The horizontal axis is the gray scale data V, and the vertical axis is the brightness L.

The calculation formula of the actual brightness of the sub-pixel is simplified to obtain the calculation formula of the compensation offset value change amount ΔVth as follows:

$$\Delta Vth=\frac{V1^2-\frac{S1}{S2}*V2^2}{2*\left(V1-\frac{S1}{S2}*V2\right)}$$

According to the calculation formula of the ideal brightness and the calculation formula of the actual brightness of the sub-pixel, the calculation formula of the actual compensation gap value K2 is obtained as follows:

$$K2=\frac{S1-S2}{ST1-ST2}*K1$$

Therefore, according to the above formula, the compensation offset value change amount ΔVth and the compensation gain value K2 of each sub-pixel in the next detection period can be determined.

Step S330: determining a compensation value of each sub-pixel in the next detection period according to the compensation offset value change amount and the compensation gain value of each sub-pixel in the next detection period, and the compensation value of the current period.

For example, the compensation value of each sub-pixel in the next detection period includes a compensation offset value and a compensation gain value K2. The compensation offset value of each sub-pixel in the next detection period is the sum of the compensation offset value Vth of the current period and the compensation offset value change amount ΔVth of the next detection period.

In step S400, in the next detection period, the source voltage signal is generated according to the preset grayscale data and the compensation value of each sub-pixel, and is output to the source driver.

For example, when each sub-pixel emits light in the next detection period, the grayscale data is preset, and then the source voltage signal is calculated according to the preset grayscale data and the compensation value of the next detection period. The calculation formula of the source voltage signal is:

$$\text{Data2}=LUT(K2)\times\text{Data1}+Vth+\Delta Vth$$

Where Data1 is the preset gray scale data, Data2 represents the source voltage signal, and LUT is a mapping function.

For example, in an exemplary embodiment, $$LUT(K2)=\frac{1}{\sqrt{K2}}.$$

In addition, when each sub-pixel is compensated for at the first time, the sub-pixel can be compensated for by presetting a compensation value as a reference during the initial detection period, and then the compensation value of the sub-pixel in the next detection period is calculated according to the preset compensation value, so that the compensation value of each sub-pixel in the next detection period is determined. In the next detection period, the compensation is performed according to the compensation value obtained by calculation, and then the compensation value of the detection period after next is obtained by calculation according to the compensation value, and thus the compensation for the sub-pixels in different detection periods is realized in such a cycle.

The detection period may be one frame, two frames, or more frames of pixels. In addition, the detection period may also be a preset time period, and the compensation calculation is performed during the frame interval between two adjacent time periods. The detection period can be set by those skilled in the art, which is not limited by the embodiments of the present disclosure.

For example, in some embodiments, the pixel compensation method may further include: generating the source voltage signal according to the grayscale data of the sub-pixel in the next display period and the compensation value in the next detection period, so as to control the light-emitting brightness of each sub-pixel in the next display period.

Figure 8:
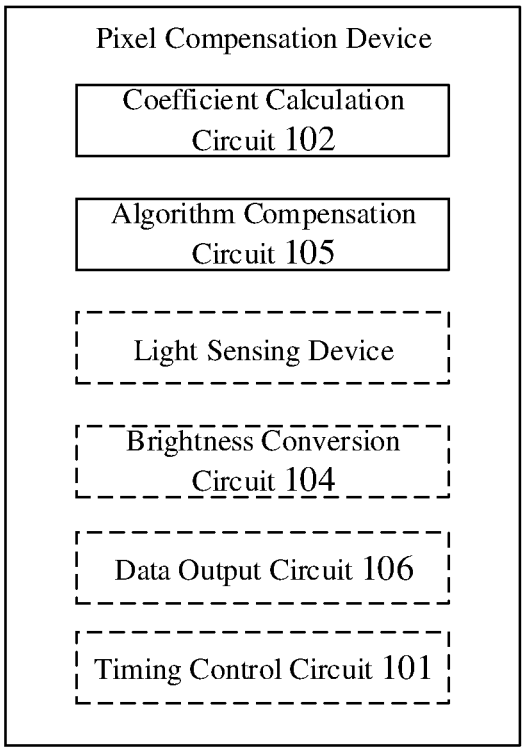
FIG. 8 is a schematic block diagram of a pixel compensation device provided by at least one embodiment of the present disclosure.

At least one embodiment of the present disclosure also provides a pixel compensation device, As illustrated in FIG. 8, the pixel compensation device according to at least one embodiment of the present disclosure includes an algorithm compensation circuit 105 and a coefficient calculation circuit 102.

Figure 4:
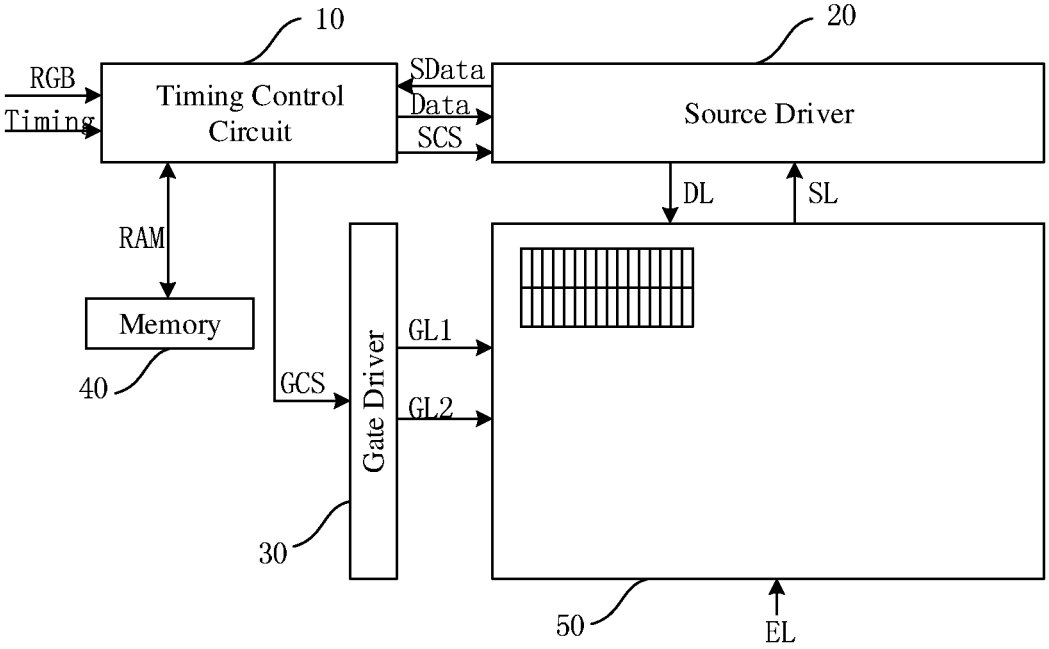
FIG. 4 is a schematic diagram of a display device provided by at least one embodiment of the present disclosure.
Figure 6:
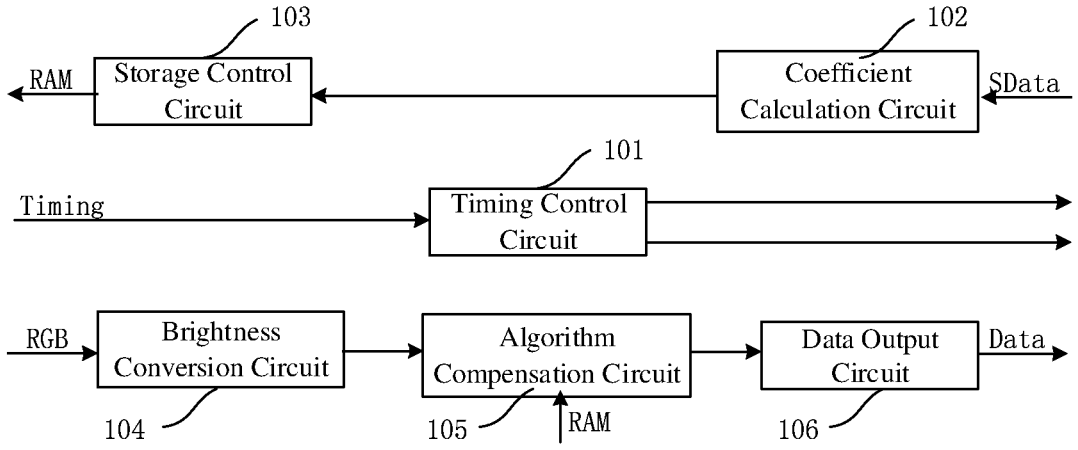
FIG. 6 is a schematic structural diagram of a timing controller in FIG. 4.

FIG. 4 is a schematic diagram of a display device provided by at least one embodiment of the present disclosure, and FIG. 6 is a schematic structural diagram of a timing controller 10 in FIG. 4. For example, as illustrated in FIG. 6, the above pixel compensation device may be included in the timing controller 10 of the display device, however, it should be understood that the embodiments of the present disclosure are not limited thereto. For example, the above-mentioned pixel compensation device may be separately provided and signal-connected to the timing controller 10.

For example, the algorithm compensation circuit 105 is used to generate a source voltage signal according to grayscale data and compensation values of a plurality of sub-pixels in the current detection period to control the light-emitting brightness of each sub-pixel.

The coefficient calculation circuit 102 is used to determine a compensation value of each sub-pixel in the next detection period according to the grayscale data, the sensing value and the compensation value of the current period of each sub-pixel.

The pixel compensation device provided in at least one embodiment of the present disclosure can determine the compensation value of each sub-pixel in the next detection period according to the grayscale data, the sensing value, and the compensation value of each sub-pixel in the current detection period. In the processing of determining the compensation value for the next detection period, according to only the current light-emitting brightness of each sub-pixel, the comprehensive aging condition of each sub-pixel unit can be obtained to output the corresponding sensing value, and then the compensation value of each sub-pixel in the next detection period can be determined by the coefficient calculation circuit 102, which can solve the problem of afterimages and the phenomenon of various traces caused by uneven brightness of a plurality of sub-pixels at one time, thereby simplifying sub-pixel compensation, improving the accuracy of pixel compensation, and improving the display quality of the display device.

In some embodiments, the pixel compensation device may further include a light sensing device for generating a sensing value according to the current light-emitting brightness of each sub-pixel. For example, the light sensing device may be attached to the outer surface of the display panel in an external attachment manner; or, the light sensing device may be provided in the display panel corresponding to the position of the light-emitting element of each sub-pixel, which is not limited by the embodiments of the present disclosure.

Furthermore, the algorithm compensation circuit 105 is also used to generate a source voltage signal according to the grayscale data and the compensation value of each sub-pixel in the next detection period, and output the source voltage signal to a source driver 20 to realize the compensation of each sub-pixel.

Hereinafter, each circuit of the pixel compensation device according to at least one embodiment of the present disclosure will be further described.

The algorithm compensation circuit 105 is used to generate a source voltage signal according to the grayscale data of a plurality of sub-pixels and the compensation value of the current detection period in the current detection period, so as to control the light-emitting brightness of each sub-pixel.

Figure 5:
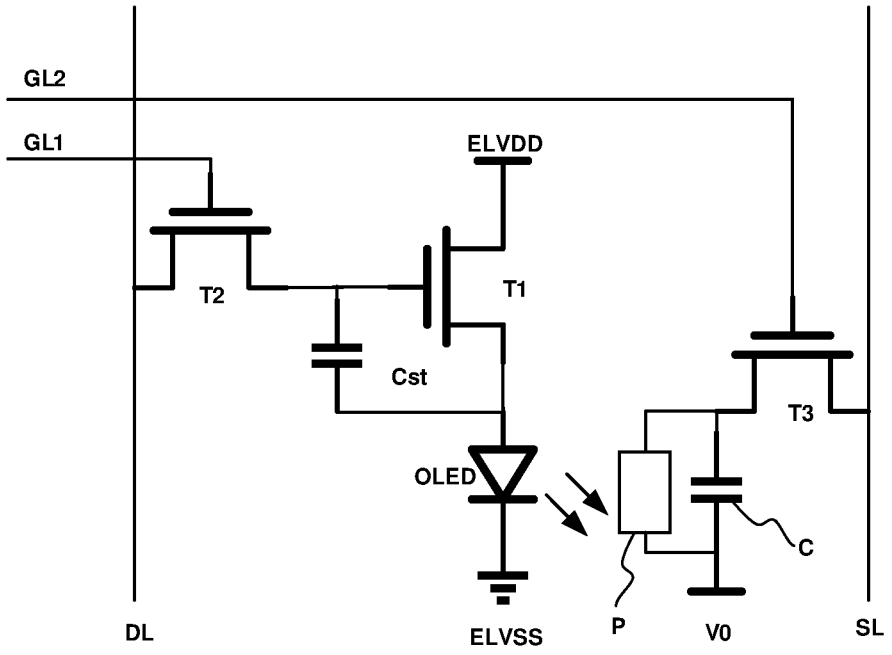
FIG. 5 is a structural diagram of a sub-pixel circuit provided by at least one embodiment of the present disclosure.

As illustrated in FIG. 5, the light sensing device may be a PIN junction P. When each sub-pixel generates corresponding brightness according to the grayscale data, light is projected onto the PIN junction P, and the comprehensive aging condition of each sub-pixel can be sensed by using the PIN junction to output the corresponding sensing value.

The coefficient calculation circuit 102 is used to determine the compensation value of each sub-pixel in the next detection period according to the grayscale data, the sensing value and the compensation value of the current period of each sub-pixel.

For example, there may be two pieces of grayscale data and two sensing values of each sub-pixel. For example, the grayscale data includes first grayscale data and second grayscale data, such as V1 and V2, the compensation value of the current period includes a compensation offset value Vth, two sensing values, i.e., a first brightness sensing value and a second brightness sensing value, such as S1 and S2, are determined according to V1+Vth and V2+Vth, an actual compensation gain value K2 and a turn-on voltage Vth1 of the sub-pixel are preset, and a brightness function of each sub-pixel is determined as:

$$S1=K2*(V1+Vth-Vth_1)^2$$

$$S2=K2*(V2+Vth-Vth_1)^2$$

The coefficient calculation circuit 102 fits the brightness curve of the sub-pixel through V1+Vth, S1, V2+Vth, and S2, where V1+Vth and V2+Vth are taken as the X coordinate values, and S1 and S2 are taken as the Y coordinate values.

In addition, more sensing values, such as S3, can be obtained through more grayscale data, such as V3, and then the voltage brightness curve of each sub-pixel can be fitted through three sets of sensing data (V1+Vth, S1, V2+Vth, S2, V3+Vth, S3) or more sets of sensing data. It should be clear to those skilled in the art that the use of more sets of sensing data can make the actual compensation gain value K2 more accurate, and thus can make the calculated brightness curve more accurate.

The coefficient calculation circuit 102 determines a compensation offset value change amount and a compensation gain value of each sub-pixel in the next detection period according to according to a brightness curve of each sub-pixel and an ideal brightness curve of each sub-pixel.

Specifically, the ideal brightness curve of each sub-pixel is obtained as follows. In the case where the grayscale data includes the first grayscale data and the second grayscale data, such as V1 and V2, the calculation formula of the ideal brightness of each sub-pixel is:

$$ST1=K1*(V1)^2$$

$$ST2=K1*(V2)^2$$

where ST1 is a first ideal brightness data, ST2 is a second ideal brightness data, and K1 is an ideal compensation gain value. For example, the first ideal brightness data ST1, the second ideal brightness data ST2 and the ideal compensation gain value K1 are preset. For example, the first ideal brightness data ST1, the second ideal brightness data ST2 and the ideal compensation gain value K1 may be theoretically derived or experimentally measured, which is not limited by the embodiments of the present disclosure.

The compensation offset value change amount ΔVth is preset to obtain the calculation formula of the actual brightness of the sub-pixel as follows:

$$S1=K2*(V1+Vth-Vth_1)^2=K2*(V1-\Delta Vth)^2\approx K2*(V1^2-2*V1*\Delta Vth)$$

$$S2=K2*(V2+Vth-Vth_1)^2=K2*(V2-\Delta Vth)^2\approx K2*(V2^2-2*V1*\Delta Vth)$$

As illustrated in FIG. 7, the dotted line is the ideal brightness curve of the sub-pixel, and the solid line is the actual brightness curve. The horizontal axis is the grayscale data V, and the vertical axis is the light-emitting brightness L.

The calculation formula of the actual brightness of the sub-pixel is simplified to obtain the calculation formula of the compensation offset value change amount ΔVth as follows:

$$\Delta Vth=\frac{V1^2-\frac{S1}{S2}*V2^2}{2*\left(V1-\frac{S1}{S2}*V2\right)}$$

The coefficient calculation circuit 102 obtains, according to the calculation formula of the ideal brightness and the calculation formula of the actual brightness of the sub-pixel, the calculation formula of the actual compensation gain value K2 as follows:

$$K2=\frac{S1-S2}{ST1-ST2}*K1$$

Thus, the purpose of determining the compensation offset value change amount ΔVth and the compensation gain value K2 of each sub-pixel in the next detection period by using the coefficient calculation circuit 102 is realized.

Further, the algorithm compensation circuit 105 is also used to generate a source voltage signal according to the grayscale data and the compensation value in the next detection period of each sub-pixel.

Specifically, when each sub-pixel emits light in the next detection period, the grayscale data is preset, and the algorithm compensation circuit 105 generates the source voltage signal by calculation according to the preset grayscale data and the compensation offset value change amount ΔVth and the compensation gain value K2 of the next detection period. The calculation formula of the source voltage signal is:

$$\text{Data2}=LUT(K2)\times\text{Data1}+Vth+\Delta Vth$$

where Data1 is the preset gray scale data, Data2 represents the source voltage signal, and LUT (Look-Up Table) is a mapping function.

For example, in an exemplary embodiment, $$LUT(K2)=\frac{1}{\sqrt{K2}}$$

In some embodiments, the algorithm compensation circuit 105 is further configured to generate a source voltage signal according to the grayscale data of the sub-pixel in the next display period and the compensation value in the next detection period, so as to control the light-emitting brightness of the sub-pixel in the next display period.

As illustrated in FIG. 8, the pixel compensation device further includes a brightness conversion circuit 104. The brightness conversion circuit 104 is used to receive the grayscale data of the sub-pixels and convert the grayscale data into a brightness voltage signal to be output to the algorithm compensation circuit 105.

In an embodiment, the grayscale data is color data RGB, and the brightness conversion circuit 104 converts the color data RGB into a corresponding brightness voltage signal to be output to the algorithm compensation circuit 105.

As illustrated in FIG. 8, the pixel compensation device further includes a data output circuit 106. The data output circuit 106 is used to generate a source voltage digital signal according to the source voltage signal to be output to the source driver 20, so as to control the brightness of the sub-pixel.

As illustrated in FIG. 8, the pixel compensation device further includes a timing control circuit 101. The timing control circuit 101 is used to receive a timing control signal Timing, generate a source voltage signal SCS (Source Control Signal) to be output to the source driver 20, generate a gate voltage signal GCS (Gate Control Signal) to be output to the gate driver 30, and generate a preset light-emitting voltage EVD (Emitting Voltage Data) to a light-emitting voltage setter.

In some embodiments, one or more of the timing control circuit 101, the coefficient calculation circuit 102, the brightness conversion circuit 104, the algorithm compensation circuit 105, and the data output circuit 106 may be realized by using a PLD (programmable logic device), a CPLD (complex programmable logic device), an FPGA (field programmable gate array), an FPOA (field programmable object array), an ASIC (application specific integrated circuit), etc., which is not limited by the embodiments of the present disclosure.

As illustrated in FIG. 4, a display device according to at least one embodiment of the present disclosure includes a timing controller 10, a source driver 20, a gate driver 30, a memory 40 and a display panel 50. As illustrated in FIG. 6, the timing controller 10 includes the above-mentioned pixel compensation device (for example, including the timing control circuit 101, the brightness conversion circuit 104, the algorithm compensation circuit 105, the data output circuit 106, and the coefficient calculation circuit 102), and a storage control circuit 103.

For example, during the inter-frame interval, the timing control circuit 101 is used to receive the timing control signal Timing, generate the source voltage signal SCS to be output to the source driver 20, and generate the gate voltage signal GCS; the brightness conversion circuit 104 receives the color data RGB, and converts the color data RGB into brightness voltage signals; the algorithm compensation circuit 105 receives the brightness voltage signal, reads the compensation value of the current detection period from the memory 40, and outputs the source voltage signal calculated according to the brightness voltage signal and the compensation value; the data output circuit 106 receives the source voltage signal, and converts the source voltage signal into a source voltage digital signal; the source driver 20 receives the source voltage digital signal to control the sub-pixel to emit light; the light sensing device outputs the sensing value according to the light of the sub-pixel; the source driver 20 receives the sensing value, and outputs a sensing value SData to the timing controller 10; the coefficient calculation circuit 102 of the timing controller 10 receives the sensing value, and outputs the compensation value of the sub-pixel sub in the next detection period through calculation according to the voltage signal, the sensing value and the compensation value of the current detection period; the storage control circuit 103 receives the compensation value of the sub-pixel in the next detection period, and writes the compensation value into the memory 40 to be used for the sub-pixel compensation in the next detection period.

According to the pixel compensation method and device of the above embodiments, at least one embodiment of the present disclosure provides a structural diagram of a sub-pixel circuit. As illustrated in FIG. 5, the sub-pixel circuit includes at least one light-emitting element, such as an OLED. A cathode of the light-emitting element is connected to a cathode voltage ELVSS is connected, and an anode of the light-emitting element is connected to a source electrode of a drive transistor T1; a drain electrode of the drive transistor T1 is connected to a anode voltage ELVDD of the light emitting element, and a gate electrode of the drive transistor T1 is connected to a drain electrode of a switching transistor T2; a gate electrode of the switching transistor T2 is connected to a first scan line GL, and a source electrode of the switching transistor T2 is connected to a data line DL; and the storage capacitor Cst is connected between the drain electrode of the switching transistor T2 and the source electrode of the driving transistor T1. The sub-pixel circuit illustrated in FIG. 5 is an example of the above-described sub-pixel, and the embodiments of the present disclosure are not limited thereto.

During the inter-frame interval, the gate voltage signal GCS controls the gate electrode of the switching transistor T2 through the first scan line GL; the source driving voltage Vdata is obtained after the source brightness data passes through the source driver 20, and then the source driving voltage Vdata is input to the source electrode of the switching transistor T2 of the sub-pixel unit through the data line DL, and thus is input to the gate electrode of the driving transistor T1; the source voltage signal SCS is mainly used to control the timing of the source driver 20, for example, the timing of outputting the source voltage signal. The anode voltage ELVDD and the cathode voltage ELVSS can set the operating voltage through the light-emitting voltage setter.

The sub-pixel circuit also includes a light sensing device for detecting the brightness of the light-emitting element. For example, as illustrated in FIG. 5, the light sensing device is implemented as a PIN junction P. The PIN junction P is connected in parallel with a storage capacitor C, and an anode of the PIN junction P is connected to a light-sensing display voltage V0. The source electrode of the switching transistor T3 is connected to a cathode of the PIN junction P, the gate electrode of the switching transistor T3 is connected to a second scanning line GL2, and the drain electrode of the switching transistor T3 is connected to a sensing line SL. When the light generated by the light emitting element is projected onto the PIN junction, the current is transmitted from the light-sensing display voltage V0 to the sensing line SL through a third switch T3. The greater the input brightness voltage, the greater the sensing value on the sensing value SL, thereby realizing the sensing of the actual light-emitting brightness of the light-emitting element based on the brightness voltage. The light-sensing display voltage V0 of the PIN junction P can be reused as the voltage signal of the light emitting element OLED.

It should be understood that, in some embodiments, the light sensing device may be included in the pixel compensation device, which is not limited by the embodiments of the present disclosure.

In this embodiment, the detection period may be one frame, two frames, or more frames of pixels. In addition, the detection period may also be a preset time period, and the compensation calculation is performed during the frame interval between two adjacent time periods. The detection period can be set by those skilled in the art, which is not limited by the embodiments of the present disclosure.

Those skilled in the art can also apply the pixel compensation device provided by the embodiments of the present disclosure to circuits of other sub-pixel units, which is not limited by the embodiments of the present disclosure.

In addition, the pixel compensation device provided by the embodiment of the present disclosure can be used to implement the pixel compensation method provided by the embodiment of the present disclosure, and has the beneficial effects of the pixel compensation method.

Figure 9:
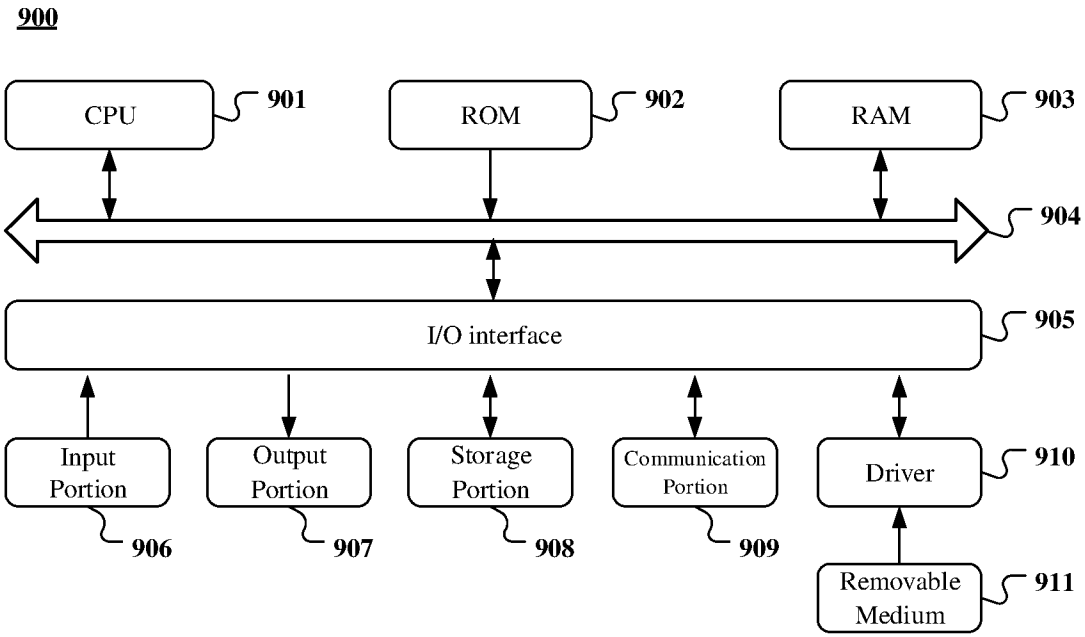
FIG. 9 is a schematic structural diagram of a computer system adapted for implementing a pixel compensation method or a pixel compensation device according to an embodiment of the present disclosure.

Referring to FIG. 9 below, FIG. 9 illustrates a schematic structural diagram of a computer system 900 adapted for implementing a pixel compensation method or a pixel compensation device according to an embodiment of the present disclosure.

As illustrated in FIG. 9, the computer system 900 includes a central processing unit (CPU) 901 that can perform various appropriate actions and processes according to the programs stored in a read-only memory (ROM) 902 or the programs loaded from a storage section 908 into a random access memory (RAM) 903. The RAM 903 also stores various programs and data necessary for the operation of the system 900. The CPU 901, ROM 902, and RAM 903 are connected to each other through a bus 904. An input/output (I/O) interface 905 is also connected to the bus 904.

The following components are connected to the I/O interface 905: an input portion 906 including a keyboard, a mouse, etc.; an output portion 907 including a cathode ray tube (CRT), a liquid crystal display (LCD), etc., and a speaker; the storage portion 908 including a hard disk, etc.; and a communication portion 909 including a network interface card, such as a LAN card, a modem, etc. The communication portion 909 performs communication processing via a network such as the Internet. A driver 910 is also connected to the I/O interface 905 as needed. A removable medium 911, such as a magnetic disk, an optical disk, a magneto-optical disk, a semiconductor memory, or the like, is installed on the driver 910 as needed, so that the computer program read out therefrom is installed into the storage portion 908 as needed.

In particular, according to an embodiment of the present disclosure, the process described above with reference to FIGS. 1 to 3 may be implemented as a computer software program. For example, embodiments of the present disclosure include a computer program product that includes a computer program tangibly contained on a machine-readable medium, the computer program containing program code for performing the methods of FIGS. 1 to 3. In such an embodiment, the computer program may be downloaded and installed from the network through the communication portion 909, and/or installed from the removable medium 911.

The flow charts and block diagrams in the accompanying drawings illustrate the possible implementation architecture, functions, and operations of systems, methods, and computer program products according to various embodiments of the present disclosure. In this regard, each block in the flow chart or block diagram may represent a module, program segment, or part of code that contain one or more executable instructions for implementing specified logical functions. It should also be noted that, in some alternative implementations, the functions marked in the blocks may also occur in an order different from that marked in the drawings. For example, two successively represented blocks can actually be performed substantially in parallel or sometimes in the reverse order depending on the functions involved. It should also be noted that each block in the block diagrams and/or flow charts and combinations of blocks in the block diagrams and/or flow charts may be implemented with a dedicated hardware-based system that performs prescribed functions or operations, or may be implemented with a combination of dedicated hardware and computer instructions.

The units or modules described in the embodiments of the present disclosure may be implemented in software or hardware. The described unit or module may also be provided in the processor. In some cases, the names of these units or modules do not constitute a limitation on the units or modules themselves.

In another aspect, the present disclosure also provides a computer-readable storage medium. The computer-readable storage medium may be a computer-readable storage medium included in the device described in the foregoing embodiments, or may be a computer-readable storage medium that exists independently and is not mounted into the device. The computer-readable storage medium stores one or more programs that are executed by one or more processors to perform the pixel compensation method described in the present disclosure.

At least one embodiment of the present disclosure also provides a display device including the pixel compensation device described above. The light sensing device in the compensation device can be attached to the outer surface of the display panel in an external attachment manner; alternatively, the light sensing device can be provided in the display panel, so that the light sensing devices correspond to the positions of the light-emitting units of the sub-pixels. An example of the display device is illustrated in FIG. 4.

The display device may be an electronic device such as a mobile phone, a tablet computer, a notebook computer, a television, an electronic advertising machine, and the like. The display device can solve the problem of afterimages and the phenomenon of various traces caused by uneven brightness of a plurality of sub-pixels at one time, which simplifies the compensation of sub-pixels and improves the accuracy of pixel compensation, thereby improving the display effect and display uniformity of the display device. For more beneficial effects, reference may be made to the beneficial effects of the pixel compensation device of the embodiments of the present disclosure, which will not be described in detail herein.

It should be noted that although several modules or units of the system for performing actions are mentioned in the above detailed description, this division is not mandatory. In fact, according to the embodiments of the present disclosure, the features and functions of the two or more modules or units described above may be embodied in one module or unit. On the other hand, the features and functions of one module or unit described above can be further divided into multiple modules or units to be embodied.

In addition, although the steps of the method in the embodiments of the present disclosure are described in a specific order in the drawings, this does not require or imply that the steps must be performed in the specific order, or all the steps illustrated must be performed to achieve the desired results. Additionally or alternatively, some steps may be omitted, multiple steps may be combined into one step for performing, and/or one step may be decomposed into multiple steps for performing, and so on.

What are described above is related to the illustrative embodiments of the disclosure only and not limitative to the scope of the disclosure; the scopes of the disclosure are defined by the accompanying claims.

What is claimed is:

1. A pixel compensation method, comprising:

generating, according to grayscale data and a compensation value of a sub-pixel in a current detection period, a source voltage signal to control light-emitting brightness of the sub-pixel;

generating a sensing value according to the light-emitting brightness of the sub-pixel; and determining a compensation value of the sub-pixel in a next detection period, according to the grayscale data, the compensation value, and the sensing value of the sub-pixel in the current detection period, wherein the determining the compensation value of the sub-pixel in the next detection period, according to the grayscale data, the compensation value, and the sensing value of the sub-pixel in the current detection period comprises:

determining a brightness curve of the sub-pixel, according to a plurality of pieces of grayscale data, a plurality of sensing values corresponding to the plurality of pieces of grayscale data, and a compensation offset value of the sub-pixel in the current detection period;

determining a compensation offset value change amount and a compensation gain value of the sub-pixel in the next detection period, according to the brightness curve of the sub-pixel and an ideal brightness curve of the sub-pixel; and determining the compensation value of the sub-pixel in the next detection period, according to the compensation offset value change amount and the compensation gain value of the sub-pixel in the next detection period and the compensation value in the current detection period, and wherein the determining the brightness curve of the sub-pixel, according to the plurality of grayscale data, the plurality of sensing values corresponding to the plurality of grayscale data, and the compensation offset value of the sub-pixel in the current detection period comprises:

according to first gray scale data and second gray scale data, a first brightness sensing value and a second brightness sensing value respectively corresponding to the first gray scale data and the second gray scale data, and the compensation offset value of the sub-pixel in the current detection period, determining the brightness curve of the sub-pixel according to following formulas:

$$S1=K2*(V1+Vth-Vth_1)^2=K2*(V1-\Delta Vth)^2\approx K2*(V1^2-2*V1*\Delta Vth)$$

$$S2=K2*(V2+Vth-Vth_1)^2=K2*(V2-\Delta Vth)^2\approx K2*(V2^2-2*V1*\Delta Vth)$$

where V1 represents the first grayscale data, V2 represents the second grayscale data, S1 represents the first brightness sensing value, S2 represents the second brightness sensing value, K2 represents the compensation gain value, Vth represents the compensation offset value, ΔVth represents the compensation offset value change amount, ΔVth=Vth1−Vth, and Vth1 represents a turn-on voltage value of the sub-pixel.

2. The pixel compensation method according to claim 1, further comprising:

generating a source voltage signal in the next detection period according to preset grayscale data of the sub-pixel and the compensation value in the next detection period, and outputting the source voltage signal to a source driver.

3. The pixel compensation method according to claim 1, wherein the determining the compensation offset value change amount and the compensation gain value of the sub-pixel in the next detection period, according to the brightness curve of the sub-pixel and the ideal brightness curve of the sub-pixel comprises:

according to the first gray scale data and the second gray scale data, first ideal brightness data and second ideal brightness data respectively corresponding to the first gray scale data and the second gray scale data, and an ideal compensation gain value, determining the ideal brightness curve according to following formulas:

$$ST1=K1*(V1)^2$$

$$ST2=K1*(V2)^2$$

where ST1 represents the first ideal brightness data, ST2 represents the second ideal brightness data, and K1 represents the ideal compensation gain value; and determining the compensation offset value change amount and the compensation gain value of the sub-pixel in the next detection period according to following formulas:

$$\Delta Vth=\frac{V1^2-\frac{S1}{S2}*V2^2}{2*\left(V1-\frac{S1}{S2}*V2\right)}$$

$$K2=\frac{S1-S2}{ST1-ST2}*K1.$$

4. The pixel compensation method according to claim 3, wherein the generating the source voltage signal in the next detection period, according to the preset grayscale data of the sub-pixel and the compensation value in the next detection period comprises:

calculating, according to the preset grayscale data of the sub-pixel and the compensation value in the next detection period, the source voltage signal by a following formula:

$$\text{Data2}=LUT(K2)\times\text{Data1}+Vth+\Delta Vth$$

where Data1 represents the preset grayscale data, Data2 represents the source voltage signal, and LUT represents a mapping function.

5. The pixel compensation method according to claim 1, further comprising:

generating, according to grayscale data of the sub-pixel in a next display period and the compensation value in the next detection period, a source voltage signal to control light-emitting brightness of the sub-pixel in the next display period.

6. A pixel compensation device, comprising:

an algorithm compensation circuit, configured to generate, according to grayscale data and a compensation value of a sub-pixel in a current detection period, a source voltage signal to control light-emitting brightness of the sub-pixel; and a coefficient calculation circuit, configured to be determine a compensation value of the sub-pixel in a next detection period, according to the grayscale data and the compensation value of the sub-pixel in the current detection period and a sensing value generated according to the light-emitting brightness provided by the sub-pixel which is driven by the source voltage signal, wherein the coefficient calculation circuit is further configured to determine a brightness curve of the sub-pixel, according to a plurality of pieces of grayscale data, a plurality of sensing values corresponding to the plurality of pieces of grayscale data, and a compensation offset value of the sub-pixel in the current detection period; determine a compensation offset value change amount and a compensation gain value of the sub-pixel in the next detection period, according to the brightness curve of the sub-pixel and an ideal brightness curve of the sub-pixel; and determine the compensation value of the sub-pixel in the next detection period, according to the compensation offset value change amount and the compensation gain value of the sub-pixel in the next detection period and the compensation value in the current detection period, and wherein the determining the brightness curve of the sub-pixel, according to the plurality of grayscale data, the plurality of sensing values corresponding to the plurality of grayscale data, and the compensation offset value of the sub-pixel in the current detection period comprises:

according to first gray scale data and second gray scale data, a first brightness sensing value and a second brightness sensing value respectively corresponding to the first gray scale data and the second gray scale data, and the compensation offset value of the sub-pixel in the current detection period, determining the brightness curve of the sub-pixel according to following formulas:

$$S1=K2*(V1+Vth-Vth_1)^2=K2*(V1-\Delta Vth)^2\approx K2*(V1^2-2*V1*\Delta Vth)$$

$$S2=K2*(V2+Vth-Vth_1)^2=K2*(V2-\Delta Vth)^2\approx K2*(V2^2-2*V1*\Delta Vth)$$

where V1 represents the first grayscale data, V2 represents the second grayscale data, S1 represents the first brightness sensing value, S2 represents the second brightness sensing value, K2 represents the compensation gain value, Vth represents the compensation offset value, ΔVth represents the compensation offset value change amount, ΔVth=Vth1−Vth, and Vth1 represents a turn-on voltage value of the sub-pixel.

7. The pixel compensation device according to claim 6, further comprising a light sensing device, wherein the light sensing device is configured to generate the sensing value according to the light-emitting brightness of the sub-pixel.

8. The pixel compensation device according to claim 6, wherein the algorithm compensation circuit is further configured to generate a source voltage signal in the next detection period according to preset grayscale data of the sub-pixel and the compensation value in the next detection period, and output the source voltage signal to a source driver, the pixel compensation device further comprises a brightness conversion circuit configured to receive the grayscale data of the sub-pixel, convert the grayscale data into a brightness voltage signal, and output the brightness voltage signal to the algorithm compensation circuit, the pixel compensation device further comprises a timing control circuit configured to receive a timing signal, and generate, according to the timing signal, a source voltage signal for controlling a source driver and a gate voltage signal for controlling a gate driver, the pixel compensation device further comprises a storage control circuit configured to be in signal connection with the coefficient calculation circuit, and to control the coefficient calculation circuit to store the compensation value of the sub-pixel in the next detection period in a memory, and the algorithm compensation circuit is further configured to generate, according to grayscale data of the sub-pixel in a next display period and the compensation value in the next detection period, a source voltage signal to control light-emitting brightness of the sub-pixel in the next display period.

9. A pixel compensation device, comprising:

a processor; and a memory configured to store instructions which, when executed by the processor, cause the processor to perform following operations:

generating, according to grayscale data and a compensation value of a sub-pixel in a current detection period, a source voltage signal to control light-emitting brightness of the sub-pixel; and determining a compensation value of the sub-pixel in a next detection period, according to the grayscale data and the compensation value of the sub-pixel in the current detection period and a sensing value generated according to the light-emitting brightness provided by the sub-pixel which is driven by the source voltage signal, wherein the determining the compensation value of the sub-pixel in the next detection period, according to the grayscale data and the compensation value of the sub-pixel in the current detection period, and the sensing value generated according to the light-emitting brightness provided by the sub-pixel which is driven by the source voltage signal comprises:

determining a brightness curve of the sub-pixel, according to a plurality of pieces of grayscale data, a plurality of sensing values corresponding to the plurality of pieces of grayscale data, and a compensation offset value of the sub-pixel in the current detection period;

determining a compensation offset value change amount and a compensation gain value of the sub-pixel in the next detection period, according to the brightness curve of the sub-pixel and an ideal brightness curve of the sub-pixel; and determining the compensation value of the sub-pixel in the next detection period, according to the compensation offset value change amount and the compensation gain value of the sub-pixel in the next detection period and the compensation value in the current detection period, and wherein the determining the brightness curve of the sub-pixel, according to the plurality of pieces of grayscale data, the plurality of sensing values corresponding to the plurality of pieces of grayscale data, and the compensation offset value of the sub-pixel in the current detection period comprises:

according to first gray scale data and second gray scale data, a first brightness sensing value and a second brightness sensing value respectively corresponding to the first gray scale data and the second gray scale data, and the compensation offset value of the sub-pixel in the current detection period, determining the brightness curve of the sub-pixel according to following formulas:

$$S1=K2*(V1+Vth-Vth_1)^2=K2*(V1-\Delta Vth)^2\approx K2*(V1^2-2*V1*\Delta Vth)$$

$$S2=K2*(V2+Vth-Vth_1)^2=K2*(V2-\Delta Vth)^2\approx K2*(V2^2-2*V1*\Delta Vth)$$

where V1 represents the first grayscale data, V2 represents the second grayscale data, S1 represents the first brightness sensing value, S2 represents the second brightness sensing value, K2 represents the compensation gain value, Vth represents the compensation offset value, ΔVth represents the compensation offset value change amount, ΔVth=Vth1−Vth, and Vth1 represents a turn-on voltage value of the sub-pixel.

10. The pixel compensation device according to claim 6, further comprising a light sensing device, wherein the light sensing device is configured to receive light emitted by the sub-pixel, and generate the sensing value according to the light-emitting brightness of the sub-pixel.

11. The pixel compensation device according to claim 6, wherein the operations further comprise:

generating a source voltage signal in the next detection period according to preset grayscale data of the sub-pixel and the compensation value in the next detection period, and outputting the source voltage signal to a source driver.

12. The pixel compensation device according to claim 9, wherein the determining the compensation offset value change amount and the compensation gain value of the sub-pixel in the next detection period, according to the brightness curve of the sub-pixel and the ideal brightness curve of the sub-pixel comprises:

according to the first gray scale data and the second gray scale data, first ideal brightness data and second ideal brightness data respectively corresponding to the first gray scale data and the second gray scale data, and an ideal compensation gain value, determining the ideal brightness curve according to following formulas:

$$ST1=K1*(V1)^2$$

$$ST2=K1*(V2)^2$$

where ST1 represents the first ideal brightness data, ST2 represents the second ideal brightness data, and K1 represents the ideal compensation gain value; and determining the compensation offset value change amount and the compensation gain value of the sub-pixel in the next detection period according to following formulas:

$$\Delta Vth = \frac{V1^2 - \frac{S1}{S2} * V2^2}{2*\left(V1 - \frac{S1}{S2} * V2\right)}$$

$$K2 = \frac{S1 - S2}{ST1 - ST2} * K1.$$

13. The pixel compensation device according to claim 12, wherein the generating the source voltage signal in the next detection period, according to the preset grayscale data of the sub-pixel and the compensation value in the next detection period comprises:

calculating, according to the preset grayscale data of the sub-pixel and the compensation value in the next detection period, the source voltage signal by a following formula:

$$\text{Data2} = LUT(K2) \times \text{Data1} + Vth + \Delta Vth$$

where Data1 represents the preset grayscale data, Data2 represents the source voltage signal, and LUT represents a mapping function.

14. The pixel compensation device according to claim 9, wherein the memory is further configured to store the compensation value.

15. The pixel compensation device according to claim 9, wherein the operation further comprises:

generating, according to grayscale data of the sub-pixel in a next display period and the compensation value in the next detection period, a source voltage signal to control light-emitting brightness of the sub-pixel in the next display period.

16. A display device, comprising the pixel compensation device of claim 9.

* * * * *